United States Patent [19]

Holdsworth

[11] 4,372,473

[45] Feb. 8, 1983

[54] STITCHING ASSEMBLY

[75] Inventor: Alan S. Holdsworth, Broadstone, England

[73] Assignee: McCorquodale Machine Systems Limited, Basingstoke, England

[21] Appl. No.: 229,022

[22] Filed: Jan. 27, 1981

[30] Foreign Application Priority Data

Jan. 31, 1980 [GB] United Kingdom ..... 8003351

[51] Int. Cl.[3] ..... B27F 7/02

[52] U.S. Cl. ..... 227/3; 227/11; 270/53

[58] Field of Search ..... 227/3, 11; 270/53

[56] References Cited

U.S. PATENT DOCUMENTS 1,983,384 12/1934 McClure ..... 227/90 X 3,416,715 12/1968 Fenimore ..... 227/3

*Primary Examiner*—Mark Rosenbaum

*Assistant Examiner*—Timothy V. Eley

*Attorney, Agent, or Firm*—Sughrue, Mion, Zinn, Macpeak and Seas

[57] ABSTRACT

A stitching assembly for stitching together sheets of paper, card and similar materials comprises a frame carrying a number of stitching machines each of which includes a stitching head and a clinch block connected together so that each stitching head and its associated clinch block are movable along the frame as a unit. A code bar assembly which is mounted on the frame includes a number of code bars and co-operating means on the stitching machines and the code bars which co-operate to locate the stitching machines at positions along the frame determined by the spacing of the co-operating means along the code bar. The spacing of the co-operating means on each of the code bars is different and the code bar assembly includes means to move the code bars to enable each one of them to be associated with the co-operating means on the stitching machine. This arrangement facilitates the repositioning of the stitching machines when it is desired to vary the location of the stitches inserted by the stitching machines for example when binding sheets of paper of different size.

15 Claims, 3 Drawing Figures

STITCHING ASSEMBLY

This invention relates to stitching assemblies for stitching and binding together sheets of paper, card and similar materials with discrete metal stitches. Typically, such discrete metal stitches are formed by a stitching head from continuous lengths of wire. The metal stitches are inserted into the sheets of paper, card or similar material adjacent the edge of the bundle of sheets and then they are covered by a binding tape which is applied over the stitches and around the edge of the bundle to form a spine. This technique of stitching and binding is used, for example, to bind books of cheques and books of tickets.

A typical binding machine incorporating the invention comprises a load platform upon which an operator places collated sheets to be bound by the machine. A sensor detects the presence of the sheets and initiates the operation of the machine. The sheets are moved into a stitching section including a number of stitching machines. Typically, there are five separate stitching machines and one or more of these may be operated at any particular time. Each stitching machine may insert more than one stitch to enable multiples of one to five stitches to be inserted into the binding. Typically, ten stitches are inserted and, in this case, after the first stitches have been inserted by the stitching machines the sheets are moved forward and then a second set of stitches are inserted. The stitching heads of the stitching machines are completely conventional in construction and examples of suitable wire stitching heads are described in U.S. Pat. Nos. 1,302,402 and 1,983,384.

The stitched bundles of pages are then moved further along the machine to a tape application section. In this section, a length of binding tape, the length of the stitched edge of the sheets, is attached to the underside of the bottom sheet of the bundle of sheets. The binding tape covers and overlaps the stitches on the bottom of the bundle and protrudes sideways from the stitched edge of the bottom sheet. The further movement of the bundle of stitched sheets along the machine carries the stitched sheets with the tape attached to a roll-over section in which a rubber roller rolls the tape around the stitched edge of the bundle of sheets and over onto the top of the bundle of sheets to cover and overlap the parts of the stitches on the top of the bundle of sheets. This completes the binding operation and the bound bundle is then delivered to a receiving hopper. The progress of the bundle of sheets through the machine and each operation is controlled by a control unit including a microprocessor and various checks are built into the machine to ensure that each step has been correctly completed before the next is initiated.

It is customary for any particular binding machine to have to bind a variety of sizes of documents and thus, it is usually desirable to be able to adjust the position of the stitching machines in the stitching assembly to vary the number, position and location of the stitching machines to take account of variations in the sizes of the bundle of sheets to be bound and whether or not they are to be subsequently guillotined into separate sections.

In the stitching assemblies of earlier machines, for example that shown in British Patent Specification No. 1,275,633, the stitching heads and their associated clinch blocks are independently attached via key-ways to a frame of the machine. To vary their locations, each stitch head is unlocked and then moved along its key-way by an operator. The operator determines the new position of the stitch head by measurement with a rule and then locks the stitch head into position. Subsequently, the clinch block then has to be moved into a position to correspond with the new position of the stitching head. After the clinch block has been re-positioned, the machine has then to be tested to ensure that it has been correctly positioned and clinches the stitches effectively. This adjustment can be particularly time consuming when carried out by an inexperienced operator and, it is very tedious for any operator.

According to this invention, a stitching assembly for stitching together sheets of paper, card and similar materials comprises a frame carrying a number of stitching machines each of which includes a stitching head and a clinch block connected together so that each stitching head and its associated clinch block are movable along the frame as a unit, a code bar assembly which is mounted on the frame and which includes a number of code bars, and co-operating means on the stitching machines and the code bars which co-operate to locate the stitching machines at positions along the frame determined by the spacing of the co-operating means along the code bar, the spacing of the co-operating means on each of the code bars being different and the code bar assembly including means to move the code bars to enable each one of them to be associated with the co-operating means on the stitching machine.

This arrangement of the stitching assembly facilitates the repositioning of the stitching machines. Firstly, the clinch block is directly connected to its associated stitching head so that the two can be moved along the frame as a unit and the clinch block is always correctly positioned with respect to its associated stitching head and therefore only a single unit needs to be re-positioned. Further, since the co-operating means on the code bar assembly and the stitching machines co-operate to define the positions of the stitching machines in the stitching assembly it is no longer necessary for an operator to determine the positions of the stitching machines by measurement but, instead, the operator merely moves the stitching machines until the co-operating means on the stitching machines and the code bars are aligned with one another.

The stitching machines are preferably fixed to one or more rails forming part of the frame and, to move the stitching machines the operator may merely urge each stitching machine along the rail or rails but preferably at least one rack is arranged parallel to the rail or rails and each stitching machine includes a shaft carrying a pinion meshing with the rack, the shaft also including a hand wheel, the arrangement being such that, upon rotation of the hand wheel, the pinion moves along the rack, and so drives the stitching machine along the rail or rails. Preferably, the stitching assembly includes two racks and two rails with one rail and rack being located adjacent the ends of the stitching machines and this ensures that the orientation of the stitching machines remains constant.

When the assembly includes at least one rack and pinion, the pinion assembly may include a locking mechanism to lock each stitching machine in position along the frame or, atlernatively, there may be sufficient friction between the stitching machines, the frame, and the co-operating means to retain each stitching machine in position. However, it is preferred that the stitching assembly also includes a separate locking mechanism which is associated with the co-operating means and which positively locks the stitching machines onto the frame so that the stitching machines are clamped onto the frame during the stitching operation. The co-operating means on the stitching machines and the code bars may be formed by slots in the code bar and projecting bars associated with each stitching machine, which fit into the slots in the code bars. In this case, it is preferred that the projecting bars on each stitching machine are movable and are connected to the locking means so that, after engagement of the projecting bars with the slots in the code bar, movement of the code bar causes movement of the projecting bars and so causes actuation of the locking means. Preferably the movable bars connected to each stitching machine include a camming surface which co-operates with a cam follower at one end of a spring biased locking rod.

The stitching assembly in accordance with this invention may form part of a complete stitching and binding machine in which all the operations are controlled by a central control unit. In this case, it is preferred that each code bar includes machine recognizable identification means and it is also preferred that the stitching assembly includes means to recognize the identity of the code bar which is associated with the stitching machines. One example of such recognizing means is an array of micro-switches arranged to engage an end portion of the code bar associated with the stitching machines. In this case, the profile of a portion of a code bar adjacent the array of micro-switches varies from code bar to code bar so that an individual identification code is formed for each code bar. Depending upon the profile of the code bar adjacent the micro-switches, the micro-switches can be arranged to be in their "on" state or in their "off" state, and depending upon which micro-switches are in the on state and which in the off state a satisfactory code can be established. For example, when the array of micro-switches includes four micro-switches, there are theoretically sixteen different code positions including the all "on" and all "off" codes. To ensure that the identification means can also recognise that at least one code bar is in position, it is preferred that when the array includes four micro-switches there are no more than fifteen different code bars.

Preferably the code bar assembly includes an elongate shaft with the individual code bars arranged parallel to and radially spaced around the shaft. Preferably the shaft includes indexing means so that it can be indexed in different angular positions to bring particular ones of the code bars into association with the stitching machines and includes a capstan to manually rotate the shaft and so vary the code bar which is associated with the stitching machines. The shaft and code bar sub-assembly may be replaced as a unitary sub-assembly to provide a greater variety in the number of code bars.

A particular example of a stitching and binding machine incorporating a stitching assembly in accordance with this invention will now be described with reference to the accompanying drawings, in which.

Figure 1:
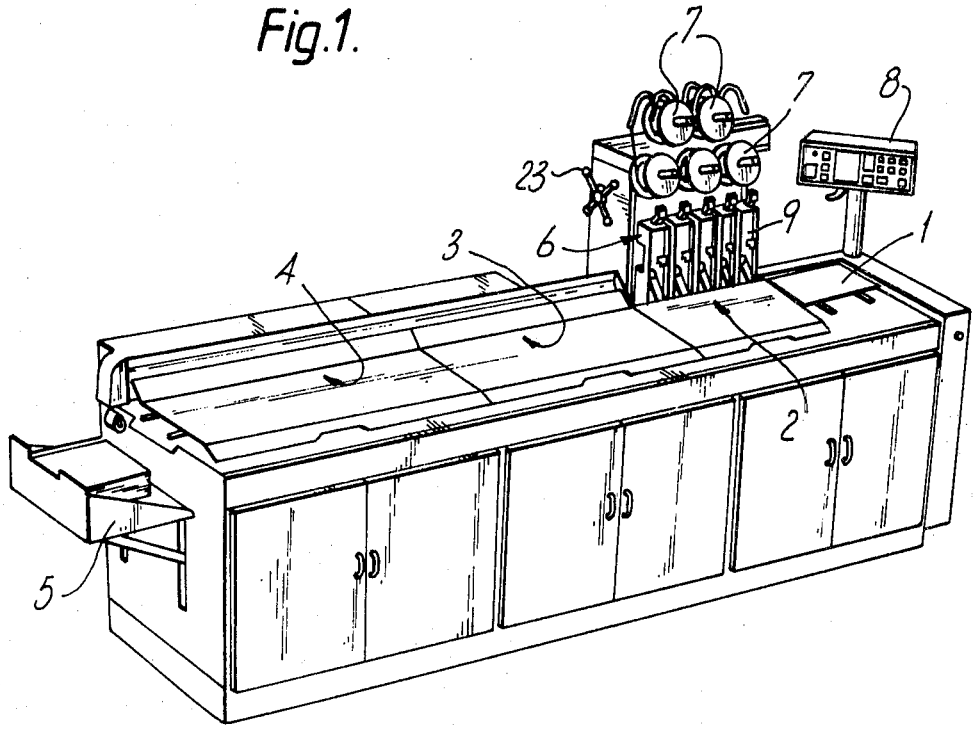
FIG. 1 is a perspective view of the entire stitching and binding machine.

The stitching and binding machine shown in FIG. 1 comprises a load platform 1 upon which a bundle of sheets to be bound into a book are placed, a stitching assembly 2 at which wire stitches are inserted through the bundle of sheets to bind them together; a tape application section 3 at which adhesive tape is applied to the bottom of the bundle of sheets to cover the stitches; a roll-over section 4 in which the adhesive tape is rolled over the edge of the sheets to be bound and over the top to cover the stitches on the top of the sheets to complete the binding; and, a discharge hopper 5 which receives the completed, bound books. The stitching assembly includes five identical stitching machines 6 each of which forms discrete metal stitches from a continuous length of wire fed to the stitching machine from an associated reel 7. The operation of the entire machine is controlled via a control panel 8 and a microprocessor unit.

The stitching assembly is arranged so that the position of the stitching machines 6 can be moved to permit the stitches to be placed in a location which is appropriate for whatever size of book is being prepared and in dependence upon whether the books are to be subjected to a subsequent guillotining operation.

Figure 3:
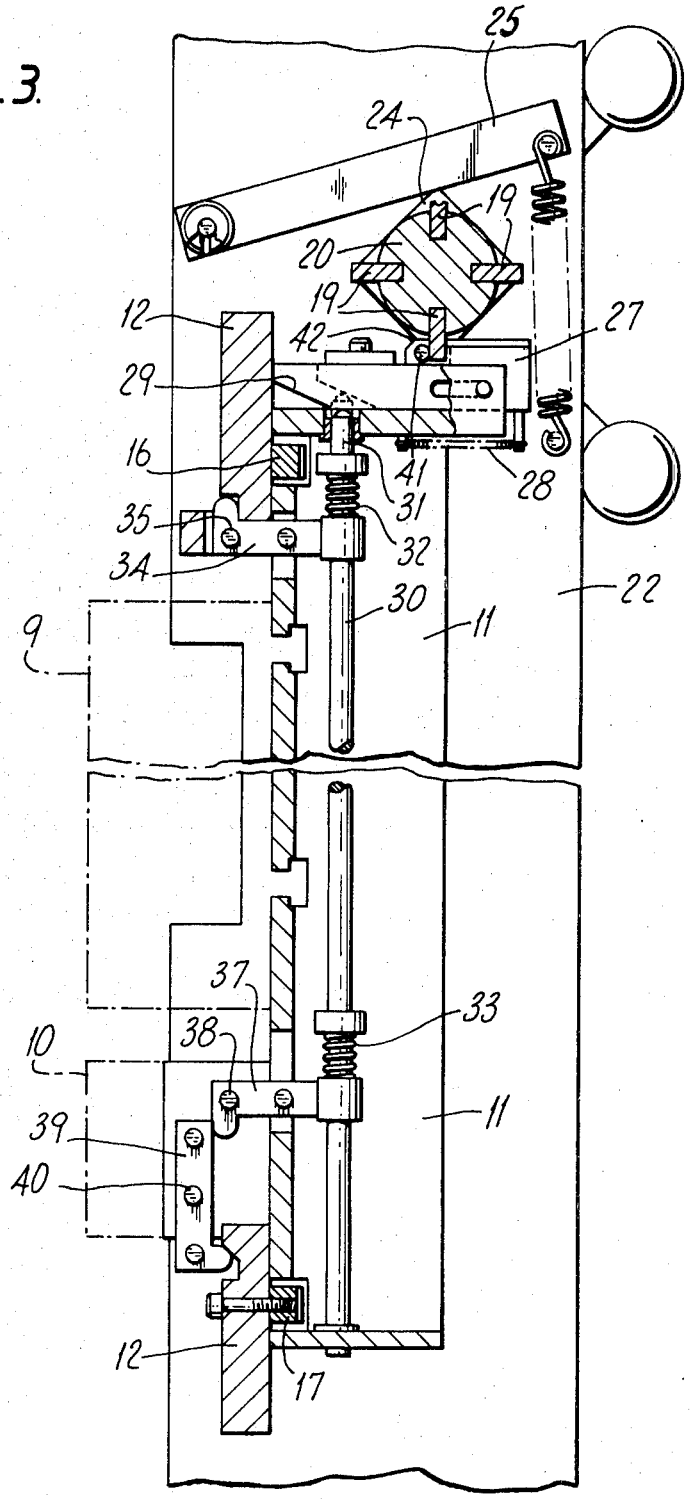
FIG. 3 is a sectional elevation taken thru a sub-frame in FIG. 2.

Each stitching machine includes a stitching head 9 and an associated clinch block 10, both of which are shown in chain dotted lines on FIG. 3. Both the stitching head 9 and the clinch block 10 of each stitching head are connected to a sub-frame 11 which is arranged to slide backwards and forward along a pair of rails 12 attached to a main frame of the stitching assembly. The sub-frames 11 rest on the top of the lower rail 12 and are arranged to move along the rails 12 each sub-frame 11 carrying with it both the stitching head 9 and its associated clinch block 10. A shaft 13 is journalled to each sub-frame 11 and carries a pair of pinions 14 and 15 which mesh with racks 16 and 17 respectively. The racks are connected to the rails 12 as shown in FIG. 3. Knurled hand wheels 18 are fixed to one end of the shafts 13 and rotation of the hand wheels 18 causes the sub-frame assembly 11 to be driven along the rails 12.

A code bar assembly includes four code bars 19 equiangularly spaced around a common shaft 20. The shaft 20 is journalled between side members 21 and 22 of the main frame. A capstan 23 is connected to the common shaft 20 to permit the shaft 20 to be rotated. A square cam 24 is included at one end of the common shaft 20 and this co-operates with a spring biased bar 25 to provide an indexing mechanism to index the code bar assembly into any one of four preferred positions.

Each of the code bars 19 includes five slots 26 distributed along its length and the position and/or spacing of the slots on each of the code bars 19 is different. A sliding bar 27 is connected to each of the sub-frames 11 with a pin and slot connection so that it can move backwards and forwards transverse to the axis of the shaft 20 and towards and away from its associated stitching machine. Each sliding bar 27 is biased by a spring 28 towards its associated stitching head 9. The top surface of one end of the sliding bars 27 is arranged to fit into the slots 26 in the code bars 19 whilst the other end of the sliding bars 27 is formed as a sloping camming surface 29.

A locking mechanism for each of the sub frames 11 to lock each of the sub-frames 11 into position on the main frame is provided by a locking bar 30, one end of which terminates in a cam follower 31. The cam follower 31 is urged against the camming surface 29 of the slide bar 27 by a pair of compression springs 32 and 33. A cranked lever 34 is pivoted at 35 and has one end connected to the locking bar 30. The cranked end of the lever 34 engages the upper rail 12 of the machine frame. A second cranked lever 37 pivoted at 38 is also connected to the locking bar 30 and the cranked end of the lever 37 bears against a further cranked lever 39 which is pivoted at 40. The cranked end of the lever 39 bears against the lower rail 12 of the main frame of the machine. Each sub-frame 11 includes a substantially identical locking mechanism.

In operation of the device the capstan 23 is rotated counter-clockwise as seen in FIG. 3 until the appropriate code bar 19 is positioned adjacent the one ends of the sliding bars 27 and the indexing mechanism formed by the square cam 24 and the spring biased lever 25 holds the code bar assembly into this position. As the capstan 23 is rotated counter-clockwise the sliding bars 27 are moved away from their stitching machines 9 when they are not aligned with the slots 26 in the adjacent code bar 19. However, the sliding bars 27 are returned by their bias springs 28 until the camming surface 29 engages the cam follower 31. The knurled wheels 18 are moved until the slide bars 27 on each of the sub-frames 11 are aligned with the slots 26 in the code bar 19 adjacent the slide bars 27.

The capstan is then rotated about an eighth of a turn clockwise into the position shown in FIG. 3. Upon rotation of the capstan 23, the code bar 19 engages pins 41 on all of the slide bars 27 to drive all the slide bars 27 forwards towards their stitching heads 9. The camming surfaces 29 on the slide bars 27 urge the locking bars 30 downwards against the bias of their compression springs 32 and 33 and, in doing so, causes the crank levers 34 and 37 to pivot about pivots 35 and 38. Pivoting of the crank levers 34 brings their cranked ends into contact with the upper rail 12 to clamp their cranked ends against the upper rail 12. Rotation of the crank levers 37 causes their cranked ends to bear against ends of the cranked levers 39 and drives the cranked end of the cranked levers 39 against the lower rail 12 to clamp the levers 39 against the rail 12. Thus, the clockwise rotation of the capstan 23 locks all of the sub-frames 11 and their associated stitching machines into position with respect to the main frame of the machine. The stitching machines can then be used to stitch bundles of sheets of paper.

To re-adjust the positioning of the stitching machines the capstan 23 is rotated counter-clockwise and, in doing so, the code bar 19 releases the pins 41. The compression springs 32 and 33 may be sufficiently strong to cause the sliding bars 27 to move but normally, as the capstan 23 is rotated further in the counter-clockwise direction to bring the required code bar 19 into position, the next code bar 19 engages abutment portions 42 or the pins 41 and drives the sliding bars 27 outwards away from their stitching machines 9 and so releases the locking bars 30 and hence unlocks the crank levers 34, 37 and 39. The capstan 23 is then rotated further in counter-clockwise direction until the appropriate code bar 19 is located above the slide bars 27. The knurled wheels 18 are rotated to re-position the stitching machines so that the slide bars 27 are aligned with the slots 26 in the code bars 19. As soon as the slide bars 27 are aligned with the slots 26 in the code bars 19, the capstan 23 is again rotated clockwise to lock the stitching machines into position by forcing the camming surface 29 against the cam follower 31 to move the locking bar 30 downwards.

Figure 2:
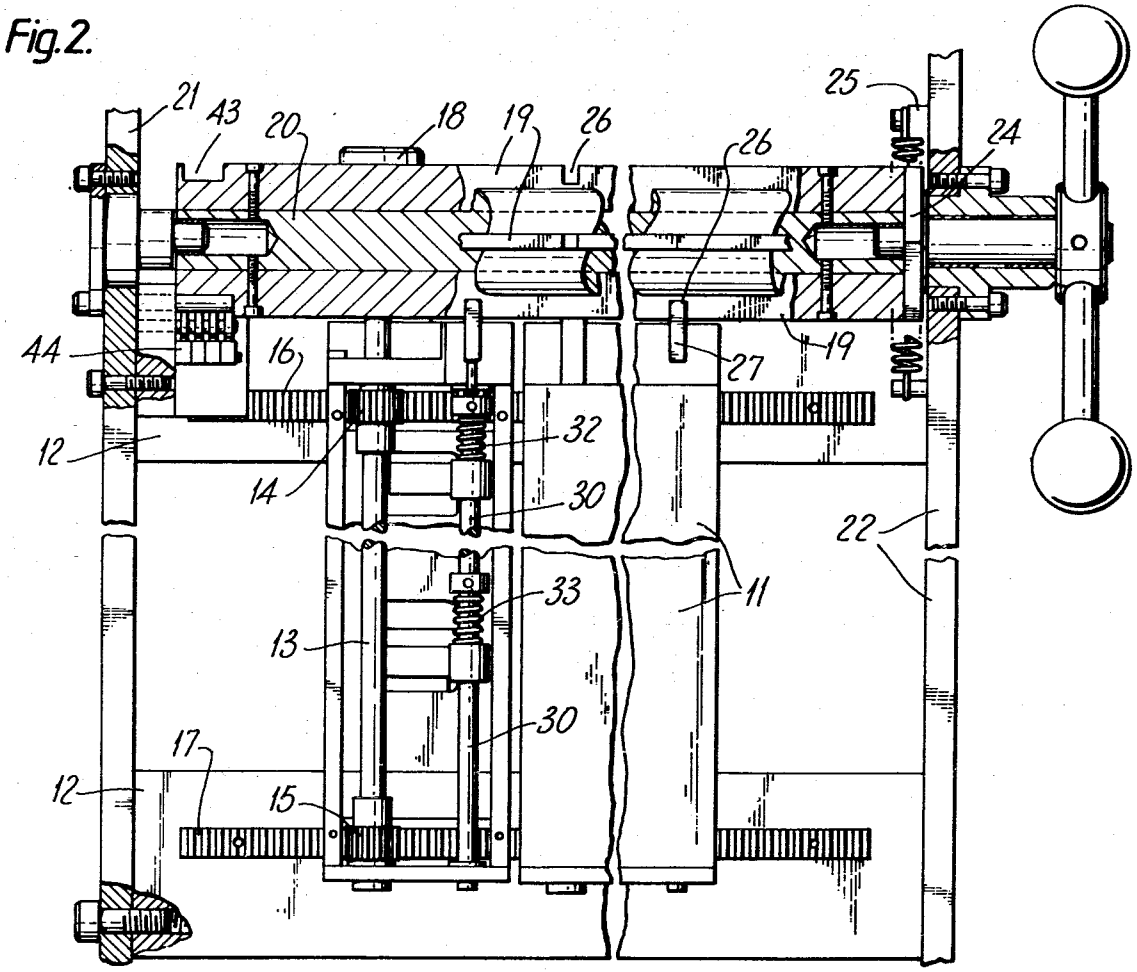
FIG. 2 is a partly cut-away rear elevation.

In addition to the slots 26 each of the code bars includes a further array of slots 43, see FIG. 2, which co-operate with an array of four micro-switches 44 to provide an indication of the particular code bar 19 which is located adjacent the stitching machines 9.

We claim:

1. A stitching assembly for stitching together sheets of paper, card, and similar materials comprising:

a plurality of stitching machines, each of said stitching machines including a stitching head, a clinch block, and means connecting together said stitching head and said clinch block to form a unitary stitching machine;

a frame;

means mounting said plurality of stitching machines on said frame for movement along said frame as a complete unit;

a code bar assembly, said code bar assembly including a plurality of code bars and co-operating means on said code bars distributed along the length of said code bars, the spacing of the co-operating means on each of the code bars being different from that upon each other of the code bars, and, means to move said code bars; and, co-operating means on the said stitching machines, said co-operating means on said stitching machines co-operating with said co-operating means on said code bars to locate said stitching machine at predetermined positions along said frame, said predetermined position being determined by said spacing of said co-operating means along said code bar adjacent said stitching machines, said means to move said code bars enabling a selected one of said code bars to be associated with said co-operating means on said stitching machines whereby the spacing of said stitching machines along said frame is variable.

2. The stitching assembly of claim 1, wherein said stitching machines are mounted on at least one rail forming part of said frame.

3. The stitching assembly of claim 2, wherein said means mounting said stitching machines on said frame include at least one rack arranged parallel to said at least one rail, a shaft, at least one pinion, said at least one pinion being mounted on said shaft, said pinion, meshing with said rack, and a hand wheel connected to said shaft whereby, upon rotation of said hand wheel, said pinion moves along said rack and thereby drives said stitching machine along said frame.

4. The stitching assembly of claim 3, wherein said means mounting said stitching machines on said frame include two said racks and two said rails with one of said rails and one of said racks being located adjacent each end of said stitching machines.

5. The stitching assembly of claim 1, wherein each of said stitching machines also includes a locking mechanism, said locking mechanism being associated with said co-operating means on said stitching machine and positively locking said stitching machines onto said frame whereby said stitching machines are clamped rigidly onto said frame during a stitching operation.

6. The stitching assembly of claim 5, wherein said co-operating means on said code bars are formed by slots in said code bars and wherein said co-operating means on said stitching machines are formed by bars associated with each stitching machine which fit into said slots in said code bars.

7. The stitching assembly of claim 6, wherein said projecting bar on each stitching machine is movable and connected to said locking means on said stitching machine whereby, after engagement of said projecting a projecting bar and said slots in said code bar, movement of said code bar causes movement of said projecting bars and thereby actuates said locking mechanism.

8. The stitching assembly of claim 7, wherein said projecting bars each include a camming surface, and wherein said locking mechanism includes a cam follower and a spring biased locking rod, said cam follower being located at one end of said spring biased locking rod, and said camming surface of said projecting bar co-operating with said cam follower to move said spring biased locking rod.

9. The stitching assembly of claim 1, wherein each of said code bars also includes machine recognizable identification means and wherein said stitching assembly further includes recognition means to recognize the identity of said particular code bar associated with said stitching machines.

10. Said stitching assembly of claim 1, wherein said means to move said code bars includes an elongate shaft, said individual code bars being arranged parallel to and radially spaced around said elongate shaft.

11. The stitching assembly of claim 10, wherein said means to move said code bars includes indexing means and a capstan, said indexing means enabling said code bar assembly to be indexed into different angular positions to bring different ones of said code bars into association with said stitching machines and said capstan permitting said shaft to be manually rotated to vary said particular code bar which is to be associated with said stitching machines.

12. The stitching assembly of claim 10, wherein said shaft and code bar sub-assembly is replaceable as a unitary sub-assembly to provide a greater number of code bars.

13. A stitching assembly for stitching together sheets of paper, card, and similar materials comprising:

a plurality of stitching machines, each of said stitching machines including a stitching head, a clinch block, means connecting together said stitching head and said clinch block to form a unitary stitching machine, and a locking mechanism;

a frame, said frame including two rails;

mounting means mounting said plurality of stitching machines on said frame for movement along said frame as a complete unit, said mounting means including two racks arranged parallel to said rails, a shaft, two pinions, said pinions being mounted on said shaft, and meshing with said racks, and a hand wheel connected to said shaft whereby, upon rotation of said hand wheel, said pinions move along said racks and thereby drive said stitching machine along said rails;

a code bar assembly, said code bar assembly including an elongate shaft, a plurality of code bars, said plurality of code bars being arranged parallel to and around said elongate shaft, a plurality of slots on said code bars distributed along the length of said code bars, the spacing of the slots on each of the code bars being different from that upon each other of the code bars, and, means to move said code bars; and, projecting bars on said stitching machines, said projecting bars on said stitching machines co-operating with said slots in said code bars to locate said stitching machines at predetermined positions along said rails, said predetermined positions being determined by said spacing of said slots along said code bars, said means to move said code bars including indexing means and a capstan, said indexing means enabling said code bar assembly to be indexed into different angular positions to bring different ones of said code bars into association with said stitching machines and said capstan permitting said shaft to be manually rotated to select said particular code bar which is to be associated with said stitching machines, whereby said spacing of said stitching machines along said frame is variable.

14. The stitching assembly of claim 13, wherein said projecting bars on each of said stitching machines are movable and are connected to said locking means on said stitching machines whereby, after engagement of said projecting bars and said slots in said code bars adjacent said stitching machines, movement of said code bar causes movement of said projecting bars and thereby actuates said locking mechanism.

15. The stitching assembly of claim 14, wherein said projecting bars each include a camming surface, and wherein said locking mechanism includes a cam follower and a spring biased locking rod, said cam follower being located at one end of said spring biased locking rod, and said camming surface of said projecting bar co-operating with said cam follower to move said spring biased locking rod.

* * * * *